US010914458B2

(12) United States Patent
Luo et al.

(10) Patent No.: US 10,914,458 B2
(45) Date of Patent: Feb. 9, 2021

(54) INTELLIGENT INDUCTION MINER'S LAMP

(71) Applicant: LEDLUCKY Holdings Company Ltd., Guangdong (CN)

(72) Inventors: Shaoqing Luo, Guangdong (CN); Jinming Li, Guangdong (CN); Zheng Xiao, Guangdong (CN); Peng Luo, Guangdong (CN)

(73) Assignee: LEDLUCKY Holdings Company Ltd., Shenzhen (CN)

( * ) Notice: Subject to any disclaimer, the term of this patent is extended or adjusted under 35 U.S.C. 154(b) by 56 days.

(21) Appl. No.: 16/468,482

(22) PCT Filed: May 18, 2018

(86) PCT No.: PCT/CN2018/087410
§ 371 (c)(1),
(2) Date: Jun. 11, 2019

(87) PCT Pub. No.: WO2019/218329
PCT Pub. Date: Nov. 21, 2019

(65) Prior Publication Data

US 2020/0393113 A1 Dec. 17, 2020

(51) Int. Cl.
*F21V 17/12* (2006.01)
*F21V 23/04* (2006.01)
(Continued)

(52) U.S. Cl.
CPC ..... *F21V 17/12* (2013.01); *F21S 8/02* (2013.01); *F21V 7/0008* (2013.01);
(Continued)

(58) Field of Classification Search
CPC ..... F21V 17/12; F21V 29/70; F21V 23/0442; F21S 8/02; F21Y 2115/10; F21W 2131/402
See application file for complete search history.

(56) References Cited

U.S. PATENT DOCUMENTS

2012/0293309 A1* 11/2012 Spiro ..... F21V 29/70 340/12.32
2015/0204528 A1* 7/2015 Zeng ..... F21V 17/101 362/363
(Continued)

FOREIGN PATENT DOCUMENTS

CN 203718563 U 7/2014
CN 203757408 U 8/2014
(Continued)

OTHER PUBLICATIONS

International Search Report and Written Opinion for corresponding international application No. PCT/CN2018/087410.

*Primary Examiner* — Anabel Ton
(74) *Attorney, Agent, or Firm* — Westman, Champlin & Koehler, P.A.

(57) ABSTRACT

The present invention discloses an intelligent induction miner's lamp. A heat dissipating portion in the miner's lamp includes a substrate, a reflector, and heat sinks; the substrate provided with a first through-hole in the center thereof is arranged on an inner wall of the reflector; an upper surface of the substrate is provided with a plurality of the heat sinks; the substrate, the reflector, and the heat sinks are integrated during casting; the power source cover is provided with a latching switch and is arranged on the reflector; the reflector is provided with a lens whose center is a recessed blind via; the lens is located on a side of a lower surface of the substrate, a ring protrusion is provided around the recessed blind via, and a sensor is arranged in the recessed blind via; the lens, the reflector, and the power source cover form a cavity; a driving power source fixed to the substrate is arranged in the cavity; and the lower surface of the substrate is provided with a light emitting element corresponding to the ring protrusion. In the present invention, the latching switch is arranged on the power source cover. Before the
(Continued)

miner's lamp is mounted, whether the miner's lamp has a sensing function can be controlled by using the latching switch. In this way, use of other lamps of the same type is not affected, the costs are low, and mounting, cable layout, and subsequent maintenance are easy.

10 Claims, 3 Drawing Sheets

(51) Int. Cl.

| | |
|---|---|
| ***F21S 8/02*** | (2006.01) |
| ***F21V 7/00*** | (2006.01) |
| ***F21W 131/402*** | (2006.01) |
| ***F21V 29/70*** | (2015.01) |
| *F21Y 115/10* | (2016.01) |

(52) U.S. Cl.
CPC ..... *F21V 23/0442* (2013.01); *F21V 29/70* (2015.01); *F21W 2131/402* (2013.01); *F21Y 2115/10* (2016.08)

(56) References Cited

U.S. PATENT DOCUMENTS

| | | | | |
|---|---|---|---|---|
| 2015/0338077 | A1* | 11/2015 | Johnson | F21V 23/045 362/234 |
| 2018/0209636 | A1* | 7/2018 | Sohn | F21V 29/75 |
| 2019/0301718 | A1* | 10/2019 | Desai | F21V 19/04 |
| 2020/0158295 | A1* | 5/2020 | Li | F21V 17/12 |

FOREIGN PATENT DOCUMENTS

| | | | |
|---|---|---|---|
| CN | 205424863 | U | 8/2016 |
| CN | 206018429 | U | 3/2017 |
| CN | 108361604 | A | 8/2018 |
| CN | 208222225 | U | 12/2018 |
| WO | WO 2018/042070 | A1 | 3/2018 |

* cited by examiner

INTELLIGENT INDUCTION MINER'S LAMP

TECHNICAL FIELD

The present invention relates to the field of miner's lamp technologies, and in particular, to an intelligent induction miner lamp.

BACKGROUND

Miner's lamps are tools used in production operation areas in factories and mines. Lighting lamps are usually evenly arranged above a jobsite or on side walls of a jobsite, to illuminate the entire working surface. Incandescent lamps, halogen tungsten lamps, and high intensity discharge lamp having larger power or a large quantity of fluorescent lamps are required. Most miner's lamps belong to this type. During city construction, a size of an illumination area on a jobsite is not restricted, and a place that is not supposed to be illuminated is exposed to strong light, thus causing light pollution. For example, light on a jobsite also illuminate residential houses, thereby causing light pollution to some people living in the residential houses. Therefore, miner's lamps having a sensing function are more widely applied.

Currently, the miner's lamp having a sensing function generally achieves the sensing function in the following two manners: In a first manner, whether the miner's lamp has the sensing function is controlled by using a remote control sensor; and in a second manner, whether the miner's lamp has the sensing function is controlled by using a wall switch. A remote apparatus has relatively complete functions but are not practical. Other lamps of the same type are affected during remote setting, and the costs are relatively high. In the wall switch manner, a driving power source adjusting light is controlled by using programs, mounting and wiring are relatively complex, it is difficult to layout cables, and it is relatively difficult to subsequently maintain the lamp.

SUMMARY

Based on this, it is necessary to provide an integrated induction miner's lamp that does not affect use of other lamps and has low costs and that is easy to mount, layout cables, and maintain subsequently.

To achieve the above objective, the present invention provides the following technical solution.

An intelligent induction miner's lamp includes a heat dissipating portion, a power source cover, a latching switch, a lens, a sensor, a driving power source, and a light emitting element, where the heat dissipating portion comprises a substrate, a reflector, and heat sinks; a center of the substrate is provided with a first through-hole, the substrate is arranged on an inner wall of the reflector, and an edge of the substrate is in contact with the inner wall of the reflector; an upper surface of the substrate is provided with a plurality of the heat sinks; the substrate, the reflector, and the heat sinks are integrated during casting; the power source cover is arranged on the reflector and is fixedly connected to the reflector, the power source cover is provided with the latching switch; the reflector is provided with the lens, and the lens is located on a side of a lower surface of the substrate; a recessed blind via is formed at a center of the lens, a ring protrusion is provided around the recessed blind via, the recessed blind via is arranged corresponding to the first through-hole, the sensor is arranged in the recessed blind via, and the sensor is electrically connected to the latching switch; the lens, the reflector, and the power source cover form a cavity; the driving power source is arranged in the cavity, the driving power source is fixed to the substrate, and the driving power source is electrically connected to the sensor; and a lower surface of the substrate is provided with the light emitting element, the light emitting element is arranged corresponding to the ring protrusion, and the light emitting element is electrically connected to the driving power source.

Optionally, the power source cover is semicircular, and a lifting eye is arranged at an external center of the power source cover.

Optionally, a second through-hole, third through-holes, and fourth through-holes are evenly formed around the lifting eye, the second through-hole is configured to fix the latching switch by using a nut, the third through-holes are configured for ventilation, and the fourth through-holes are configured to fix the power source cover to the heat dissipating portion by using a screw.

Optionally, the second through-hole, the third through-holes, and the fourth through-holes are raindrop-shaped through-holes.

Optionally, the heat sinks are evenly arranged on the substrate around the first through-hole in a radial direction.

Optionally, the substrate is further provided with a plurality of fixing posts, and the fixing posts are configured to fixedly connect the driving power source to the heat dissipating portion by using screws.

Optionally, the light emitting element consists of a plurality of white LED beads.

Optionally, the sensor is fixed to the recessed blind via by using a screw.

Optionally, the lens is fixedly connected to the reflector in the heat dissipating portion by using a screw.

Optionally, the latching switch and the driving power source are respectively electrically connected to the sensor by using silicone wires.

Compared with the prior art, beneficial effects of the present invention lie in:

The present invention provides an intelligent induction miner's lamp. The miner's lamp includes: a heat dissipating portion, a power source cover, a latching switch, a lens, a sensor, a driving power source, and a light emitting element; the heat dissipating portion includes: a substrate, a reflector, and heat sinks; the substrate whose center is provided with a first through-hole is arrange on an inner wall of the reflector; an upper surface of the substrate is provided with a plurality of the heat sinks; the substrate, the reflector, and the heat sinks are integrated during casting; the power source cover is provided with the latching switch and is arranged on the reflector; the reflector is provided with the lens whose center is a recessed blind via; the lens is located on a side of a lower surface of the substrate, a ring protrusion is provided around the recessed blind via, and the sensor is arranged in the recessed blind via; the lens, the reflector, and the power source cover form a cavity; a driving power source fixed to the substrate is arranged in the cavity; and the lower surface of the substrate is provided with the light emitting element corresponding to the ring protrusion. In the miner's lamp in the present invention, the latching switch is arranged on the power source cover. Before the miner's lamp is mounted, whether the sensor works can be controlled by using the latching switch. That is, before the miner's lamp is mounted, whether the miner's lamp has a sensing function can be controlled by using the latching switch. In this way, use of other lamps of the same type is not affected, the costs are low, the mounting is easy and convenient, and cable layout and subsequent maintenance are easy; in addition, different requirements can be satisfied without replacing any lamp, which is convenient and efficient.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

DETAILED DESCRIPTION

The following describes in detail the technical solutions in the embodiments of the disclosure with reference to the accompanying drawings in the embodiments of the disclosure. Apparently, the described embodiments are merely a part rather than all of the embodiments of the disclosure. All other embodiments obtained by a person of ordinary skill in the art without creative efforts on the basis of the embodiments of the disclosure shall fall within the scope of protection of the disclosure.

The following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

To make objectives, features, and advantages of the present invention more comprehensible, the following describes the present invention in more detail with reference to accompanying drawings and specific implementations.

Figure 1:
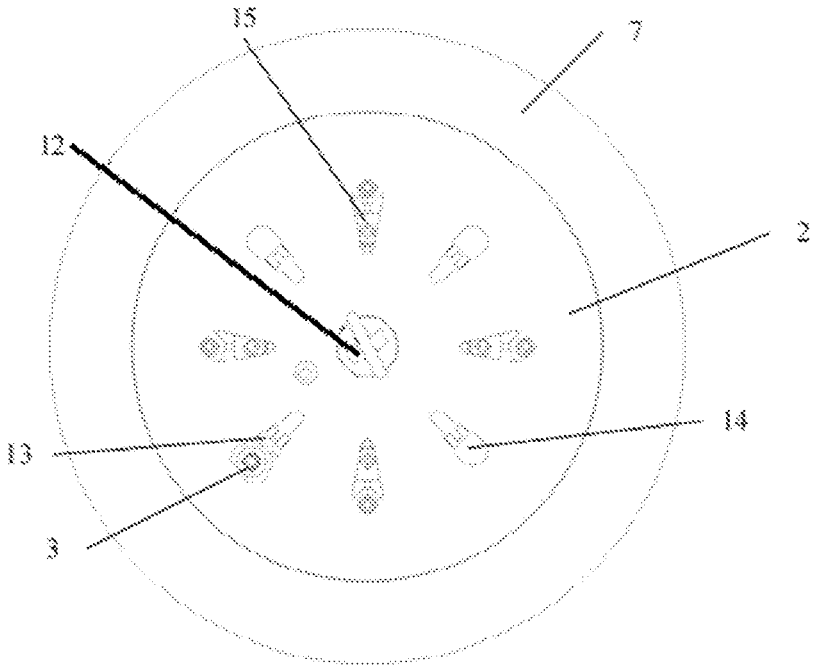
FIG. 1 is a top view of an intelligent induction miner's lamp according to an embodiment of the present invention.
Figure 2:
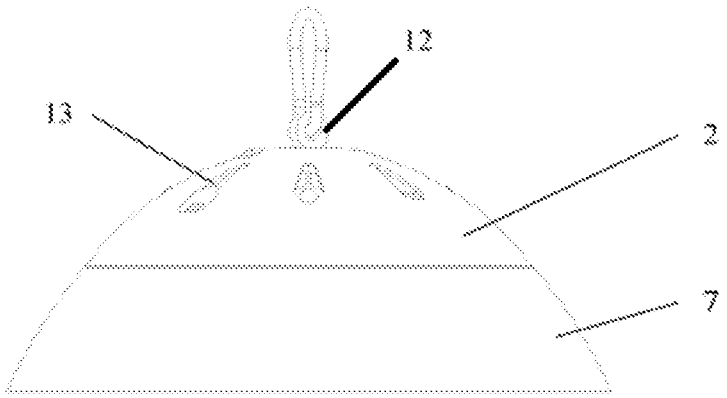
FIG. 2 is a main view of an intelligent induction miner's lamp according to an embodiment of the present invention.
Figure 3:
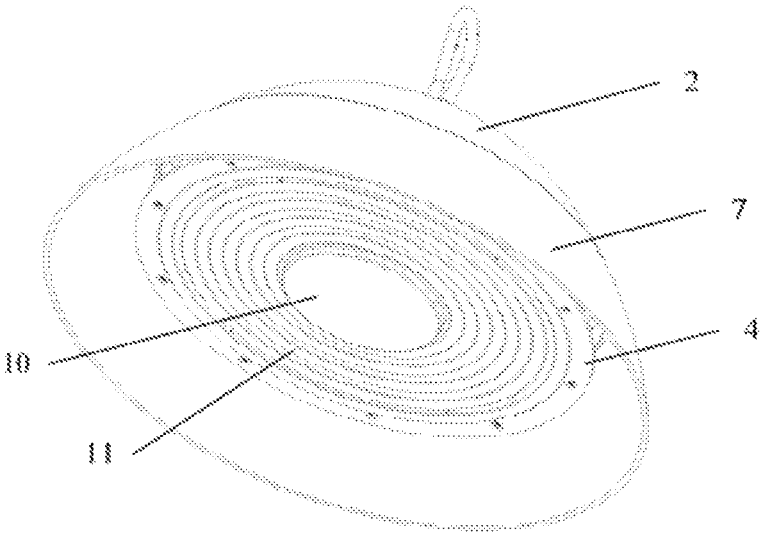
FIG. 3 is a three-dimensional diagram of an intelligent induction miner's lamp according to an embodiment of the present invention.
Figure 4:
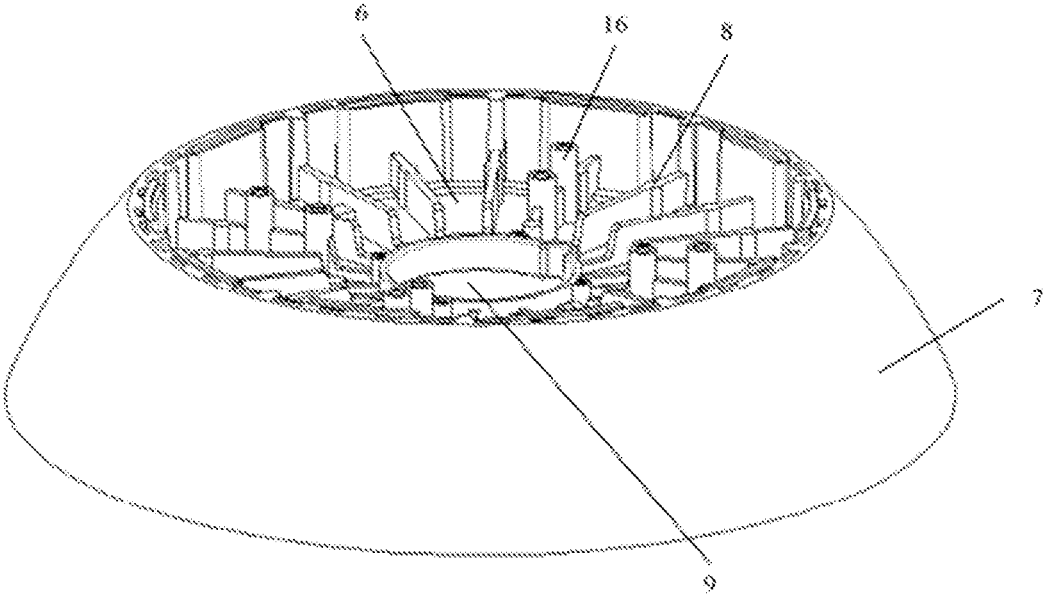
FIG. 4 is a schematic structural diagram of a heat dissipating portion of an intelligent induction miner's lamp according to an embodiment of the present invention.
Figure 5:
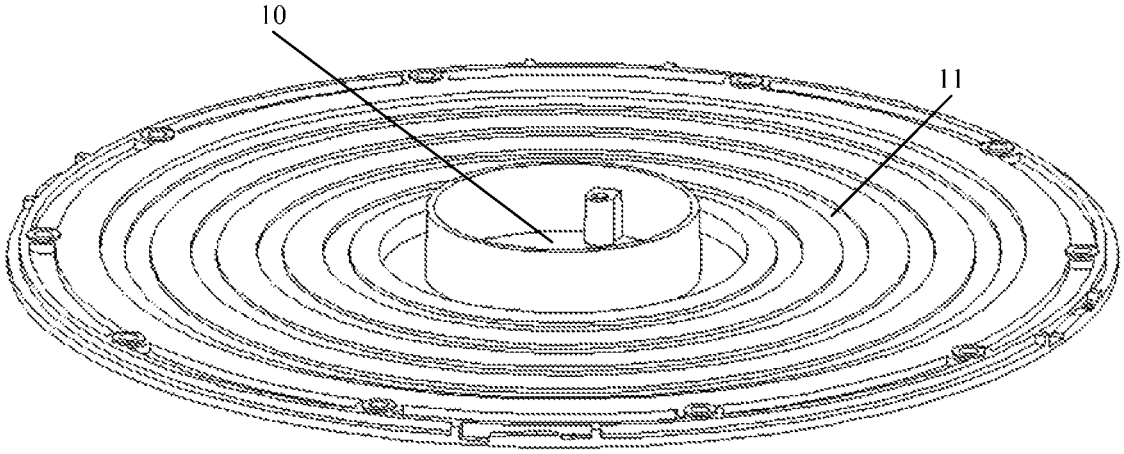
FIG. 5 is a schematic structural diagram of a lens of an intelligent induction miner's lamp according to an embodiment of the present invention.
Figure 6:
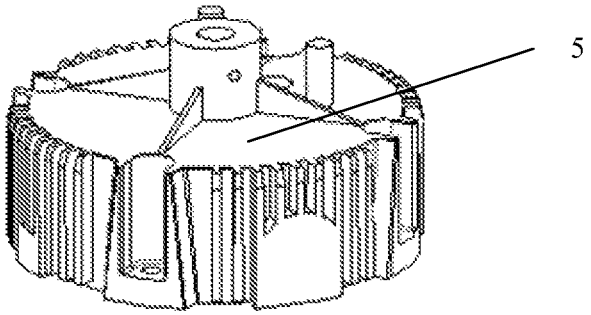
FIG. 6 is a schematic structural diagram of a driving power source of an intelligent induction miner's lamp according to an embodiment of the present invention.

Referring to FIG. 1 to FIG. 6, an intelligent induction miner's lamp in the embodiments includes: a heat dissipating portion 1, a power source cover 2, a latching switch 3, a lens 4, a sensor, a driving power source 5, and a light emitting element, where the heat dissipating portion 1 includes a substrate 6, a reflector 7, and heat sinks 8; a center of the substrate 6 is provided with a first through-hole 9, the substrate 6 is arranged on an inner wall of the reflector 7, and an edge of the substrate 6 is in contact with the inner wall of the reflector 7; an upper surface of the substrate 6 is provided with a plurality of the heat sinks 8; the substrate 6, the reflector 7, and the heat sinks 8 are integrated during casting; the power source cover 2 is arranged on the reflector 7 and is fixedly connected to the reflector 7, the power source cover 2 is provided with the latching switch 3; the reflector 7 is provided with the lens 4, and the lens 4 is located on a side of a lower surface of the substrate 6; a recessed blind via 10 is formed at a center of the lens 4, a ring protrusion 11 is provided around the recessed blind via 10, the recessed blind via 10 is arranged corresponding to the first through-hole 9, the sensor is arranged in the recessed blind via 10, and the sensor is electrically connected to the latching switch 3; the lens 4, the reflector 7, and the power source cover 2 form a cavity; the driving power source 5 is arranged in the cavity, the driving power source 5 is fixed to the substrate 6, and the driving power source 5 is electrically connected to the sensor; and a lower surface of the substrate 6 is provided with the light emitting element, the light emitting element is arranged corresponding to the ring protrusion 11, and the light emitting element is electrically connected to the driving power source 5.

In an optional implementation, a surface of the lens 4 except the ring protrusion 11 is a texturing frosted surface.

In an optional implementation, the power source cover 2 is semicircular, and a lifting eye 12 is arranged at an external center of the power source cover 2.

In an optional implementation, a second through-hole 13, third through-holes 14, and fourth through-holes 15 are evenly formed around the lifting eye 12, the second through-hole 13 is configured to fix the latching switch 3 by using a nut, the third through-holes 14 are configured for ventilation, and the fourth through-holes 15 are configured to fix the power source cover 2 to the heat dissipating portion 1 by using a screw. In this implementation, eight through-holes are evenly formed around the lifting eye 12, which are one second through-hole 13, three third through-holes 14, and four fourth through-holes 15. The fourth through-holes 15 are formed at intervals around the lifting eye 12, and the second through-hole 13 or the third through-hole 14 is disposed between every two of the fourth through-holes 15. The second through-hole 13, the third through-holes 14, and the fourth through-holes 15 are raindrop-shaped through-holes.

In an optional implementation, the heat sinks 8 are evenly arranged on the substrate 6 around the first through-hole 9 in a radial direction.

In an optional implementation, the substrate 6 is further provided with a plurality of fixing posts 16, and the fixing posts 16 are configured to fixedly connect the driving power source 5 to the heat dissipating portion 1 by using screws.

In an optional implementation, the light emitting element consists of a plurality of white LED beads.

In an optional implementation, the sensor is arranged in the recessed blind via 10 by using a screw; and the lens 4 is fixedly connected to the reflector 7 in the heat dissipating portion 1 by using a screw.

In an optional implementation, the latching switch 3 and the driving power source 5 are respectively electrically connected to the sensor by using silicone wires.

In the miner's lamp in this implementation, the latching switch is arranged on the power source cover. Before the miner's lamp is mounted, whether the sensor works can be controlled by using the latching switch. That is, before the miner's lamp is mounted, whether the miner's lamp has a sensing function can be controlled by using the latching switch. In this way, use of other lamps of the same type is not affected, the costs are low, the mounting is easy and convenient, and cable layout and subsequent maintenance are easy; in addition, different requirements can be satisfied without replacing any lamp, which is convenient and efficient.

The embodiments of the disclosure are described in detail above with reference to the accompanying drawings, but the disclosure is not limited to the above embodiments. Within the knowledge of a person of ordinary skill in the art, various variations can also be made without departing from the spirit of the disclosure.

What is claimed is:

1. An intelligent induction miner's lamp, comprising: a heat dissipating portion, a power source cover, a latching switch, a lens, a sensor, a driving power source, and a light emitting element, wherein the heat dissipating portion comprises a substrate, a reflector, and heat sinks; a center of the substrate is provided with a first through-hole, the substrate is arranged on an inner wall of the reflector, and an edge of the substrate is in contact with the inner wall of the reflector; an upper surface of the substrate is provided with a plurality of the heat sinks; the substrate, the reflector, and the heat sinks are integrated during casting; the power source cover is arranged on the reflector and is fixedly connected to the reflector, the power source cover is provided with the latching switch; the reflector is provided with the lens, and the lens is located on a side of a lower surface of the substrate; a recessed blind via is formed at a center of the lens, a ring protrusion is provided around the recessed blind via, the recessed blind via is arranged corresponding to the first through-hole, the sensor is arranged in the recessed blind via, and the sensor is electrically connected to the latching switch; the lens, the reflector, and the power source cover form a cavity; the driving power source is arranged in the cavity, the driving power source is fixed to the substrate, and the driving power source is electrically connected to the sensor; and a lower surface of the substrate is provided with the light emitting element, the light emitting element is arranged corresponding to the ring protrusion, and the light emitting element is electrically connected to the driving power source.

2. The miner's lamp according to claim 1, wherein the power source cover is semicircular, and a lifting eye is arranged at an external center of the power source cover.

3. The miner's lamp according to claim 2, wherein a second through-hole, third through-holes, and fourth through-holes are evenly formed around the lifting eye, the second through-hole is configured to fix the latching switch by using a nut, the third through-holes are configured for ventilation, and the fourth through-holes are configured to fix the power source cover to the heat dissipating portion by using a screw.

4. The miner's lamp according to claim 3, wherein the second through-hole, the third through-holes, and the fourth through-holes are raindrop-shaped through-holes.

5. The miner's lamp according to claim 1, wherein the heat sinks are evenly arranged on the substrate around the first through-hole in a radial direction.

6. The miner's lamp according to claim 1, wherein the substrate is further provided with a plurality of fixing posts, and the fixing posts are configured to fixedly connect the driving power source to the heat dissipating portion by using screws.

7. The miner's lamp according to claim 1, wherein the light emitting element consists of a plurality of white LED beads.

8. The miner's lamp according to claim 1, wherein the sensor is fixed to the recessed blind via by using a screw.

9. The miner's lamp according to claim 1, wherein the lens is fixedly connected to the reflector in the heat dissipating portion by using a screw.

10. The miner's lamp according to claim 1, wherein the latching switch and the driving power source are respectively electrically connected to the sensor by using silicone wires.

* * * * *